United States Patent [19]

Ord

[11] Patent Number: 4,948,310

[45] Date of Patent: Aug. 14, 1990

[54] RAIL VEHICLE FOR TRANSPORTING ROAD SEMI-TRAILERS

[75] Inventor: Robert M. Ord, Weybridge, England

[73] Assignee: Tiphook Plc., United Kingdom

[21] Appl. No.: 350,002

[22] Filed: May 10, 1989

[51] Int. Cl.[5] ..... B65P 1/00; B60P 3/06

[52] U.S. Cl. ..... 410/1; 410/6

[58] Field of Search ..... 410/1, 6

[56] References Cited

U.S. PATENT DOCUMENTS

| | | | |
|---|---|---|---|
| 3,352,438 | 11/1967 | Davidson | 410/1 |
| 3,916,799 | 11/1975 | Smith | 410/1 |

FOREIGN PATENT DOCUMENTS

| | | | |
|---|---|---|---|
| 1944831 | 3/1971 | Fed. Rep. of Germany | 410/1 |
| 8102142 | 8/1981 | Fed. Rep. of Germany | 410/1 |
| 3234374 | 3/1984 | Fed. Rep. of Germany | 410/1 |
| 901275 | 7/1962 | United Kingdom | 410/1 |

*Primary Examiner*—Andres Kashnikow

*Assistant Examiner*—Virna Lissi Mojica

*Attorney, Agent, or Firm*—Watson, Cole, Grindle & Watson

[57] ABSTRACT

A rail vehicle has a body with a hollow center section that accommodates the suspension and landing legs of a road semi-trailer thus enabling the combined vehicles to be transported on a rail system with a restrictive loading gauge. The rail vehicle utilizes a two axle suspension arranged around the road vehicle components to provide a rail vehicle of the shortest possible length. Part of the center section of the rail vehicle can be swung outward on a sliding bearing thus enabling a road trailer to be loaded or unloaded from the side by means of a conventional road tractor unit and obviating the need for expensive terminal equipment. The wagon frame joining the parts of the wagon carrying the rail suspension is prestressed to ensure that vertical bearing surfaces of the sliding bearing are maintained in contact thus improving the integrity of the wagon and ensuring operation.

10 Claims, 3 Drawing Sheets

RAIL VEHICLE FOR TRANSPORTING ROAD SEMI-TRAILERS

BACKGROUND OF THE INVENTION

This invention relates to a rail vehicle for transporting road semi-trailers.

Rail vehicles for transporting road semi-trailers are well known and comprise a flat rail vehicle with provision for retaining the road vehicle by means of a dummy fifth wheel plate and wheel troughs. The road vehicle is loaded onto the rail vehicle by means of lifting with a crane, or it is driven onto the rail vehicle by means of ramps and a special road tractor unit. In some countries with a small loading gauge the road vehicle wheels are also retracted into a pocket in the frame of the rail vehicle.

Some countries, particularly Great Britain, have a very restrictive loading gauge which makes existing vehicles unusable. Also the terminal costs for the existing systems are very expensive.

In an attempt to overcome these problems of terminal costs, rail wagons have been designed which enable a trailer to be loaded using the conventional tractor unit to drive the trailer on the and off of the wagon. The first proposals simply involved driving tractor trailer combinations along the length of a train and sequentially stopping the combinations at the last available space. This arrangement is disclosed in GB No. 1,190,963 and EPO 019,098 and has the disadvantage that loading and unloading times are long and the rail wagons have to be provided with removable buffing arrangements.

As improved arrangement involving the use of pivotably load bearing structures has also been proposed eg. in EP 023,372 and WO81/02142 but in these cases, the pivotable structure is centre pivoted and relatively high. An end pivoted arrangement has been disclosed in EP 181676 but again the combination of rail wagon and trailer is relatively high, which means that it is difficult if not impossible to comply with the loading gangs of many countries when using large trailers. Yet centre variation is disclosed in GB No. 901,275.

In our earlier patent application GB No. 2,179,311 a rail wagon is disclosed using swing-out section located intermediate end frames each of which carries conventional rail suspension and buffing. The swing-out section is connected to the end frames so as to maintain the structural integrity of the wagon in all locations of opening and closing of the swing-out section. However, experience with this construction has shown that over time it can become difficult to ensure smooth functioning of the swing-out section and locking of the swing-out section in the closed position.

BRIEF DESCRIPTION OF THE INVENTION

According to the present invention there is provided a rail vehicle for transporting a load comprising a body having first and second end body portions joined to each other by a prestressed intermediate body section portion, to ensure that vertical sliding bearing means remain in contact at all time.

A preferred rail vehicle according to the invention comprises a body which enables a slightly modified road semi-trailer to sit within that body structure, so that the combined rail and road vehicle does not exceed even the British Rail loading gauge. The invention permits a trailer to be loaded or unloaded from the side by means of a conventional road tractor unit. This obviates the need for expensive terminal equipment.

The other corner of said one end of the load receiving platform is preferably provided with a further sliding bearing for locating the other corner when the platform is in the open position. The sliding bearing between the other end of the load receiving platform and the second body portion is preferably arranged to support one corner of the other end of the load receiving platform when the platform is in the open position.

A preferred embodiment of the invention has a support member releaseably secured to the second body portion for supporting the other end of the load receiving platform when in its open position. The support member may comprise a ground engaging leg whose length can be altered to allow adjustment for uneven surfaces. The support member may be operated by a powered mechanism, such as a powered screw.

DETAILED DESCRIPTION OF EMBODIMENT

A specific embodiment of the invention will now be described by way of example with reference to the accompanying drawing in which.

Figure 1:
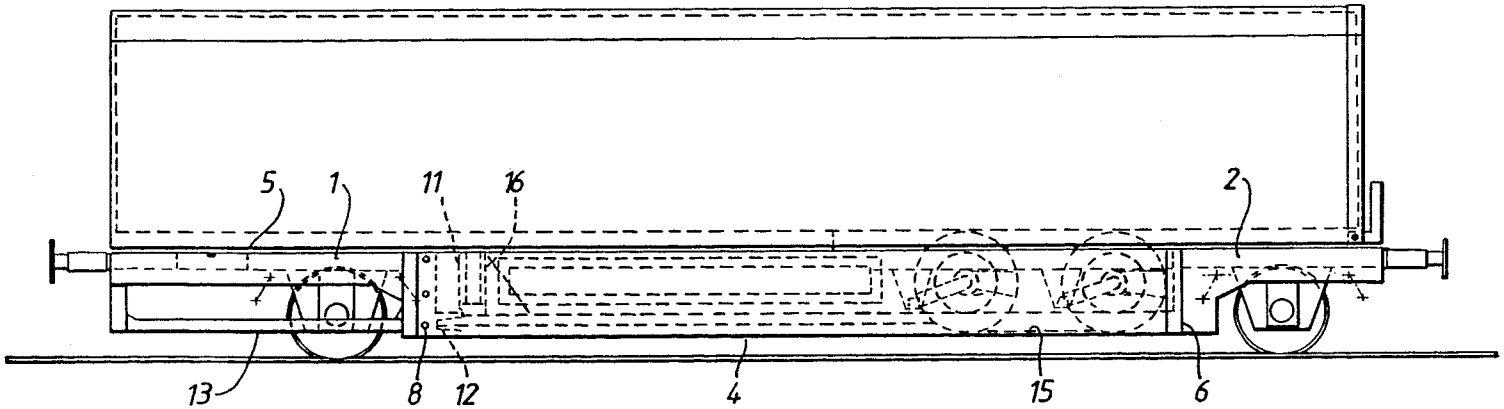
FIG. 1 shows an elevation of the combination rail and road semi-trailer.

Referring to the drawing: the rail vehicle comprises a single rail transport unit complete with buffer, coupling and braking system, all of which enable the vehicle to operate with existing rail traffic: either as an empty rail vehicle or as one transporting a road semi-trailer in all conditions of loading.

FIG. 1 illustrates a road semi-trailer, of maximum permitted road length and width, placed inside the rail vehicle in such a way that the rail vehicle is of the shortest possible rail length and of the simple two-axle type. The compact configuration of the rail vehicle results in rail axle centres which allow the use of an existing standard type rail suspension; and since rail vehicle width and height are a function of axle centres, available load space is optimized. The weight of the road suspension offsets the non-symmetrical positions of the rail axles. The road wheels are positioned as low as possible within the rail structure, which remains inside the rail loading gauge. The trailer sits on its own wheels, and additional clearance can be obtained at the top of the loading gauge by using air suspension on the trailer, and the deflating the air bags.

The road tires and a sprung dummy fifth wheel mounting plate 5 provide a secondary suspension to the trailer and its load.

The rail vehicle structue comprises an end frame 1 or second end body portion complete with rail suspension, buffers, coupling and dummy fifth wheel plate 5, another end frame 2 or first body portion, similar to 1 but constructed as short as possible to fit inside the trailer rear overhang. The rail suspension unit on the end frame is spaced from the adjacent end of the rail vehicle by a distance different from the distance between the rail suspension unit on the end frame 1 and the end of the vehicle adjacent the second suspension unit. A side frame or longitudinal member 3 connects the end frames 1 and 2 together. A swing-out section 4 comprising a side frame integral with a low floor completes the basic structure. The plane of the floor is lower than the plane containing the axles of the rail suspension units. The swing-out structure 4 pivots about a hinge 6 and is locked into place to form a complete rail vehicle structure by fastenings 7, 8 and 9. The swing-out structure 4 is held stable whilst open by a sliding joint 10, by a support buttress 11 which slides against the end frame 1, and by a slot 12 in the end frame 1 along with a support member including an arm or support member 13, which pivots from the rail vehicle. Vehicle loading is aided by wheel troughs in the floor section of 4 and by ramps 14, which are stored on the floor section when not in use. A powered screw located in support arm 13 enables the swing-out structure to be operated.

The support arm 13 may be provided with a leg member having a foot for engaging the ground. The length of the leg member may be adjustable for uneven surfaces.

Figure 3:
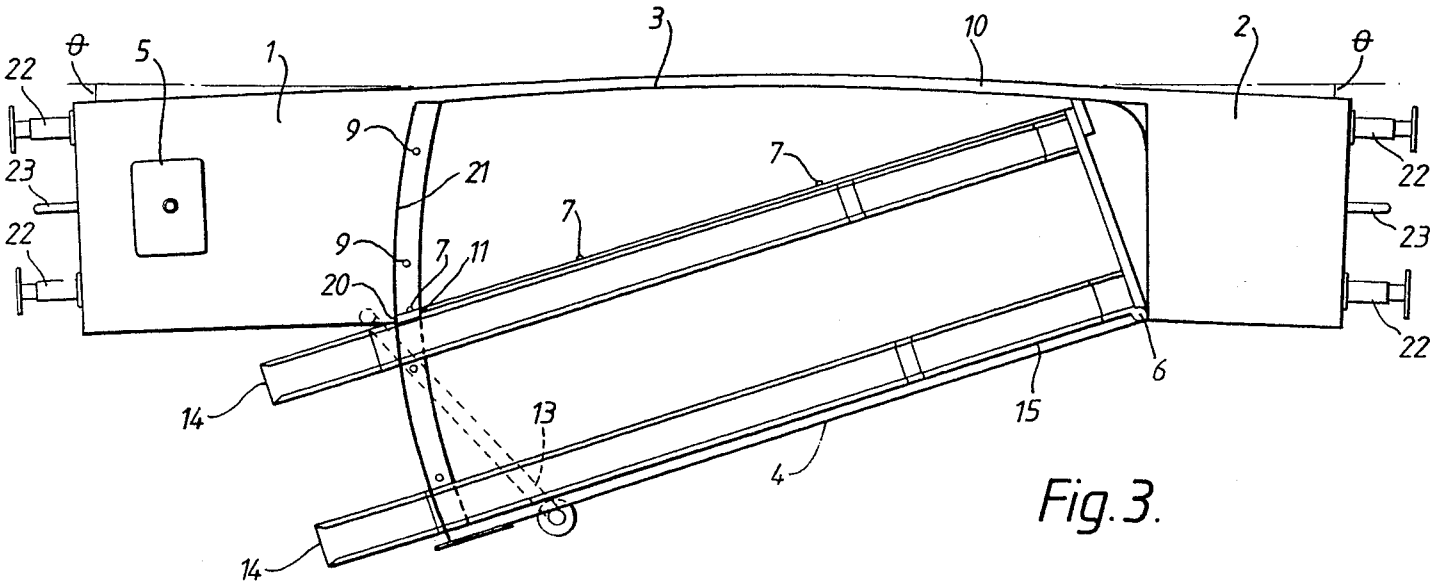
FIG. 3 shows a diagram of the rail vehicle to illustrate the construction.

An important feature of the construction of the rail wagon is shown in FIG. 3 which is a diagrammatic plan view of the wagon. It has been found to be useful in practice to pre-stress the longitudinal side frame 3 so that, as shown, the end frames are at a slight angle to the longitudinal axis of the wagon when the swing-out structure 4 is pivoted to the open position. The prestressing ensures that the vertical surface 20 of the buttress 11 is an engagement with corresponding vertical bearing surface or means 21 on the arcuate track on the end frame 1 throughout the movement of the swing-out structure. This has been found to prevent sticking or fouling of the swing-out structure 4 when loaded with a trailer and the arrangement is such that when the swing-out section is pivoted to a closed position, the end frames are forced into alignment by the swing-out structure 4. The arrangement also ensures that when in the closed position the swing-out structure 4 can be locked in position and the complete wagon be rigid. Were the prestressing not used, it is conceivable that over a period of time is would become difficult, if not impossible to lock the structure 4 into the closed position.

Loading of a road semi-trailer is carried out as follows.

Figure 2:
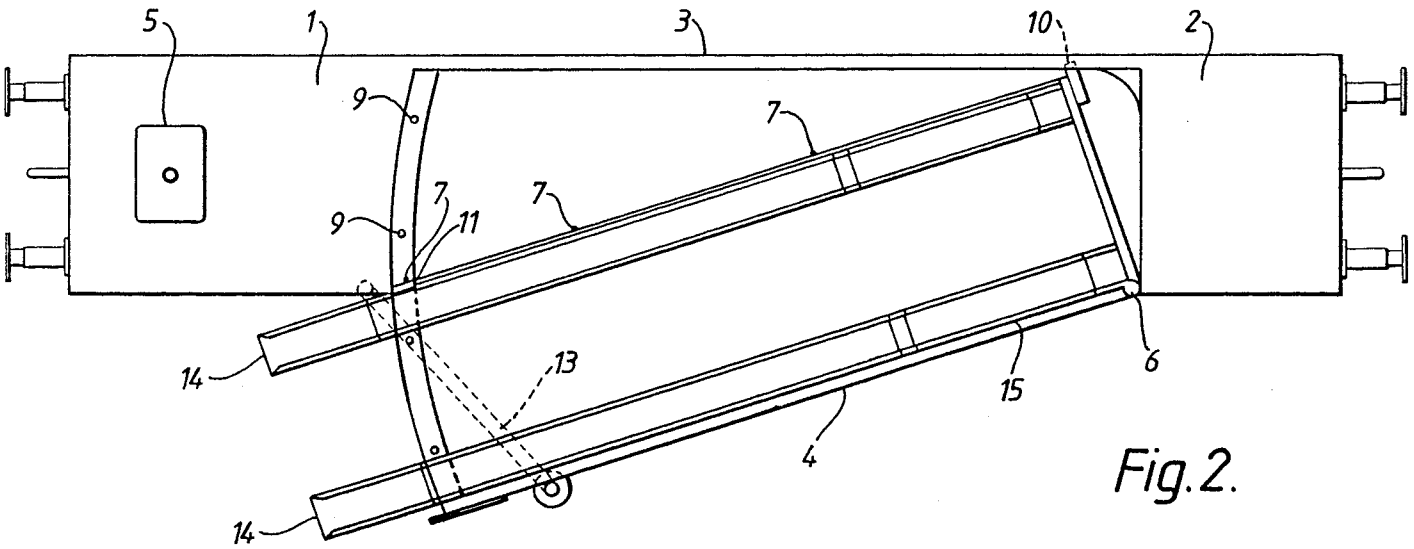
FIG. 2 shows a plan view of the rail vehicle with the centre of the frame swung open for loading of a rail semi-trailer.

The support arm 13 is pivoted out from the rail frame, lowered, and its foot then placed on the ground. The fasteners 7, 8 and 9 are released and the swing-out structure 4 is opened with the use of the powered screw mechanism located in 13. The ramps 14 are pulled down from their storage place on the floor section and are then placed in position. The condition of the rail vehicle is now as illustrated in FIG. 2.

The trailer under run protection, if fitted, is swung up and the trailer is reversed into the swing-out structure 4 by means of a standard road tractor unit. The trailer wheels settle into wells 15 in the wheel troughs when finally located. The trailer landing legs 16 are lowered into pockets, not shown, on the floor and then the tractor unit is withdrawn in the normal way. The trailer is now accurately aligned in the swing-out section 4 by means of the wheel troughs, wheel wells and the landing leg pockets. The swing-out structure with the trailer is transferred to the closed position by means of the power screw mechanism located in 13, and is then secured to the rest of the rail structure by the fasteners 7, 8 and 9. The trailer is lowered by releasing the air in the air suspension and in the landing legs. This results in the trailer king pin being locked into the dummy sprung fifth wheel mounting plate 5.

To remove the road trailer from the rail vehicle the procedure described above should be reversed.

The example illustrates a rail vehicle with side loading and unloading capability. The vehicle could then be used with crane loading or unloading facilities.

The example illustrates a rail vehicle transporting a road semi-trailer with a van body. Other types of road vehicle semi-trailers or even other vehicles can also be transported.

The example illustrates a rail vehicle transporting a road semi-trailer with two axles. A road vehicle with one or three axles or even a draw bar trailer can also be transported.

The invention relates to a rail vehicle for transporting road semi-trailers but the rail vehicle can also be adapted to carry containers, such as 40ft containers.

The end frame 1 and 2 may be provided with rail buffing and draw gear 23 of suitable height to conform with existing standard type rail suspension rolling stock.

I claim:

1. In a rail vehicle for transporting a load comprising a body having first and second end body portions each provided with a rail suspension unit and joined to each other by a longitudinal member, an intermediate body portion connected between the first and second end body portions and comprising a rectangular load receiving platform, one end of which is hinged at one corner to the first body portion and the other end of which contact the second body portion through a sliding bearing whereby to enable the load receiving platform to be laterally pivoted about the hinge to an open position and permit loading and unloading of the vehicle from the side, the improvement comprising the sliding bearing including vertical bearing means on the second body portion and the intermediate body portion, the longitudinal member being prestressed to maintain the vertical bearing means in contact.

2. A rail vehicle according to claim 1, wherein the other corner of said one end of the load receiving platform is provided with a further sliding bearing for locating the other corner when the load receiving platform is in the open position.

3. A rail vehicle according to claim 1, wherein the sliding bearing between the other end of the load receiving platform and the second body portion is arranged to support one corner of the other end of the load receiving platform when the platform is in the open position.

4. A rail vehicle according to claim 1, and comprising a support member releasably secured to the second body portion for supporting the other end of the load receiving platform when in its open position.

5. A rail vehicle according to claim 4, wherein the support member comprises a ground engaging leg member whose length can be altered to allow adjustment for uneven surfaces.

6. A rail vehicle according to claim 1, wherein the rail suspension unit on the first body portion is spaced from the adjacent end of the rail vehicle by a distance different from the distance of the rail suspension unit on the second body portion from the end of the rail vehicle adjacent the second rail suspension unit.

7. A rail vehicle according to claim 1, wherein the load receiving platform lies in a plane below the level of a plane containing the axles of the rail suspension units.

8. A rail vehicle according to claim 1, wherein the first and second end body portions are provided with a rail buffing and draw gear of a height to conform with standard type rail suspension.

9. A rail vehicle according to claim 1, wherein the top of the second end body portion is provided with a sprung fifth wheel plate.

10. A rail vehicle according to claim 1, wherein the load receiving platform is provided with wheel receiving wells adjacent said one end for the wheels of a trailer.

* * * * *